US006206190B1

(12) United States Patent
Brochhausen

(10) Patent No.: US 6,206,190 B1
(45) Date of Patent: Mar. 27, 2001

(54) COLLECTIBLE CARD AND CAN PACKAGE AND METHOD

(75) Inventor: James M. Brochhausen, Irving, TX (US)

(73) Assignee: Playoff Corporation, Grand Prairie, TX (US)

( * ) Notice: Subject to any disclaimer, the term of this patent is extended or adjusted under 35 U.S.C. 154(b) by 0 days.

(21) Appl. No.: 08/828,431

(22) Filed: Mar. 28, 1997

(51) Int. Cl.[7] ..... B65D 8/00
(52) U.S. Cl. ..... 206/457; 206/459.5
(58) Field of Search ..... 206/425, 457, 206/449, 454, 456, 459.5, 216

(56) References Cited

U.S. PATENT DOCUMENTS

| | | | |
|---|---|---|---|
| 4,007,868 | 2/1977 | Kusunoki | 229/20 |
| 4,224,364 | 9/1980 | Hunt | 428/11 |
| 4,559,729 | 12/1985 | White | 40/306 |
| 4,671,406 | 6/1987 | Baer | 206/315.9 |
| 4,829,691 | 5/1989 | Manjos et al. | 40/661 |
| 5,147,041 | 9/1992 | Lemieux et al. | 206/449 |
| 5,186,566 | 2/1993 | Cameron | 402/79 |
| 5,351,851 | 10/1994 | Powell | 220/503 |
| 5,363,964 | 11/1994 | Hexter, Jr. | 206/449 |
| 5,503,274 | 4/1996 | Toffler et al. | 206/457 |
| 5,522,163 | 6/1996 | Neugebauer | 480/780 |

*Primary Examiner*—Jacob K. Ackun
(74) *Attorney, Agent, or Firm*—Baker & Botts L.L.P

(57) ABSTRACT

A collectible package (36) includes at least one collectible card (10) having a face (16) that includes a first distinctive image (32). The first distinctive image (32) may include subject matter concerning a sports personality, a music personality, a film personality, a cartoon character, or a tourist attraction. A can (34) has a first end (26, 28), a second end (26, 28), and a wall (18) coupling the first end (26, 28) and the second end (26, 28). The can (34) may include a second distinctive image (38) that relates to the first distinctive image (32), and may be configured according to the first distinctive image (32). The card (10) is sealed within the can (34) to form the collectible package (36).

10 Claims, 2 Drawing Sheets

COLLECTIBLE CARD AND CAN PACKAGE AND METHOD

TECHNICAL FIELD OF THE INVENTION

This invention relates in general to a field of collectible items, and more particularly to a collectible card and can package and method.

BACKGROUND OF THE INVENTION

Many people collect items such as coins, cards, cans, and the like for amusement, profit, or other reasons. For example, a person might collect cards with images of sports personalities to acquire particular cards or a collection of cards over a period of time. The value of each card may be determined, at least in part, according to the image associated with the card, the difficulty associated with collecting the card, based on its rarity or other factors, and the package with which the card is sold, distributed, or otherwise associated.

As collectible items become increasingly varied and valuable, people may collect items and associated packages that are increasingly interesting and visually pleasing. One type of container includes a depression or indentation in a selected area of its external side wall to receive an article. The article may be retained in the depression or indentation using an adhesive or film overlay, which may be transparent to allow viewing of the article. Another container includes a two-piece can having a prize indicia imprinted on the interior of the can and an openable segment to provide a pour hole for the contents of the can. When the contents of the can have been emptied, the prize indicia is visible through the pour hole. Although these containers may be adequate for viewing articles or indicia from outside the containers, none of these containers provide a package for one or more collectible cards that each have a distinctive image. In addition, none of these containers provide a package for one or more collectible cards that relates to the collectible cards and is itself distinctive. As a result, these containers are inadequate to meet the needs and to provoke the interest of many collectors.

SUMMARY OF THE INVENTION

The present invention provides a collectible card and can package and method that addresses disadvantages and problems associated with collectible items.

According to one embodiment of the present invention, a collectible package includes at least one collectible card having a face that includes a first distinctive image. The first distinctive image may include subject matter that concerns a sports personality, a music personality, a film personality, a cartoon character, a tourist attraction, or other suitable subject matter. A can has a first end, a second end, and a wall coupling the first end and the second end. The can may include a second distinctive image that relates to the first distinctive image, and may be configured according to the first distinctive image. The card is sealed within the can to form the collectible package.

The present invention provides a number of important technical advantages. The collectible card and can package of the present invention provides a package for one or more collectible cards that each have a distinctive image. The cards may be selected at random, such that an undetermined number of packages may be collected before a particular card and associated distinctive image are collected. In addition, the can of the card and can package may include a distinctive image that is related to the distinctive images of the collectible cards and is itself distinctive. As a result, the collectible card and can package of the present invention provokes the interest of collectors to add value to the collectible cards that are sealed within the can of the package.

BRIEF DESCRIPTION OF THE DRAWINGS

For a more complete understanding of the present invention and for further features and advantages thereof, reference is now made to the following description taken in conjunction with the accompanying drawings, in which.

DETAILED DESCRIPTION OF THE INVENTION

Figure 1:
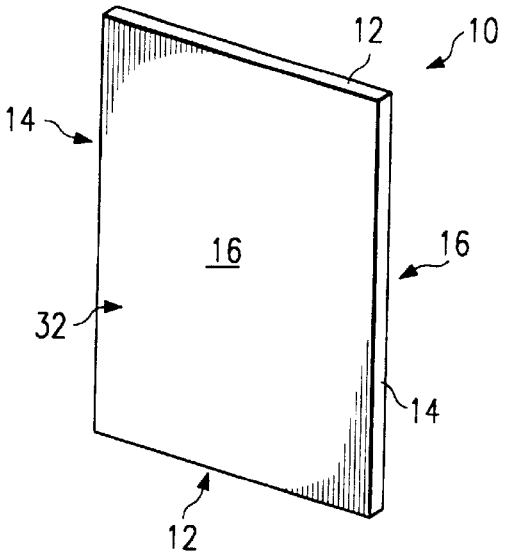
FIG. 1 illustrates an exemplary collectible card according to the invention.

FIG. 1 illustrates an exemplary collectible card 10 having edges 12 and edges 14. Although edges 12 and 14 are shown as being horizontal and vertical, respectively, the present invention contemplates card 10 having edges of any suitable shape. For example, edges 12 may be substantially horizontal and edges 14 may be substantially vertical. The corners of card 10 may be rounded, diagonal relative to edges 12 and 14, or in any other suitable shape. Edges 12 and 14 may be smooth, rough, ridged, jagged, or in any other suitable configuration. In one embodiment, card 10 resembles a conventional trading card and edges 12 and 14 are approximately 2.5 in and 3.5 in long, respectively. Edges 12 and 14 define faces 16 that may be substantially rectangular, substantially circular, or may have any other suitable shape or arrangement.

At least one of the faces 16 of card 10 includes a distinctive image 32 that concerns one or more sports personalities, music personalities, film personalities, cartoon characters, tourist attractions, or any other subject matter suitable for printing or otherwise including on a collectible card. Distinctive image 32 may include one or more photographs, holographic features, relief features, lenticular lenses, or any other appropriate features or characteristics, in any suitable combination. Each face 16 of card 10 may include a distinctive image 32 that is identical to or different from distinctive image 32 of the other face 16. Each face 16 of card 10 may include a single or multiple distinctive images 32. In one embodiment, at least one distinctive image 32 of each card 10 is different from distinctive images 32 of all other cards 10, such that numerous cards 10 may be collected before card 10 with a particular distinctive image 32 is collected.

Figure 2A:
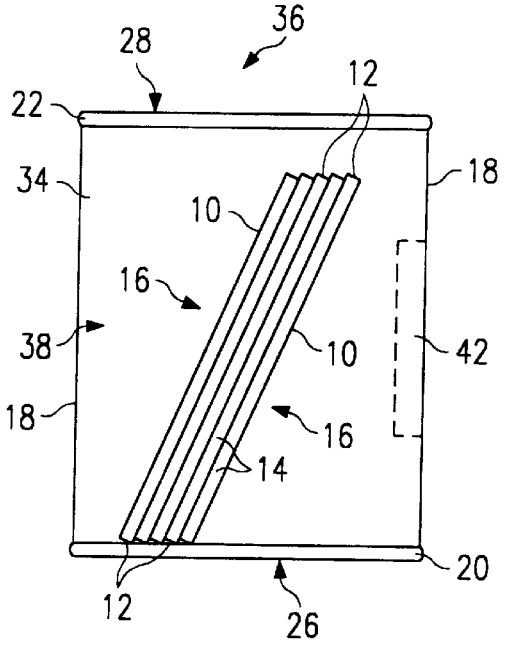
FIGS. 2*a* and 2*b* illustrate an exemplary collectible card and can package according to the present invention.
Figure 2B:
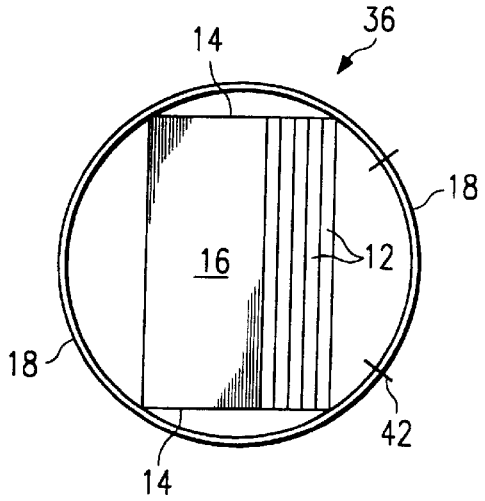

FIGS. 2*a* and 2*b* illustrate an exemplary collectible card and can package 36 that includes one or more cards 10 enclosed within a sealed or other suitable can 34. In one embodiment, can 34 has a substantially cylindrical wall 18, a substantially circular bottom 26, and a substantially circular top 28 that are coupled to one another in the manner discussed more fully below with reference to FIG. 4. Although can 34 is discussed as being substantially cylindrical, the present invention contemplates can 34 having any configuration suitable to contain one or more cards 10. In one embodiment, can 34 is substantially or completely sealed, such that cards 10 are not viewable unless can 34 is unsealed using a can opener, pull tab opener, or in another appropriate manner. Alternatively, although can 34 is sealed or substantially sealed, can 34 may include a window 42 formed from transparent plastic or any other suitable material to allow at least one card 10 or another article sealed within can 34 to be viewed. Can 34 may include ridges 22 that separate bottom 26 and top 28 of can 34 from wall 18.

Can 34 may include a distinctive image 38 that relates in some manner to the subject matter of distinctive image 32 of one or more cards 10 contained within can 34. For example, cards 10 may each include a distinctive image 32 relating to a different personality within a particular sport, such as Michael Jordan, and distinctive image 38 of can 34 may relate more generally to the particular sport, in this case basketball. Furthermore, the size and shape of can 34 may be selected according to distinctive image 32, distinctive image 38, or both distinctive images 32 and 38. For example, if distinctive images 32 of cards 10 within can 34 concern motor sports personalities, can 34 may be the size and shape of a conventional oil can. The present invention contemplates other similar relationships between can 34 and distinctive image 32 or 38 in which can 34 is configured according to distinctive images 32 or 38. In one embodiment, cards 10 contained within can 34 are selected more or less randomly, such that numerous collectible card and can packages 36 may be collected before a particular card 10 or collection of cards 10 may be collected.

Figure 3:
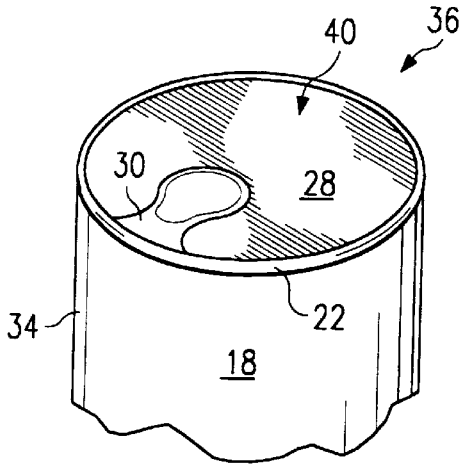
FIG. 3 illustrates an exemplary collectible card and can package having a pull tab opener.

FIG. 3 illustrates collectible card and can package 36 having a pull tab opener 30 for unsealing can 34. Although pull tab opener 30 is discussed, the present invention contemplates unsealing can 34 in any appropriate manner using a conventional can opener, punch, or any other suitable technique, according to the configuration of can 34. In one embodiment, can 34 resembles a conventional sealed can used for packaging and distributing vegetables and the like. Bottom 26, top 28, or both bottom 26 and top 28 of can 34 may include a distinctive image 40 that relates in some manner to the subject matter of distinctive image 32 of card 10, distinctive image 38 of can 34, or both distinctive image 32 and distinctive image 38. As a result, coin and card package 36 that includes one or more collectible cards 10 is provided that is itself desirable for collection.

Figure 4:
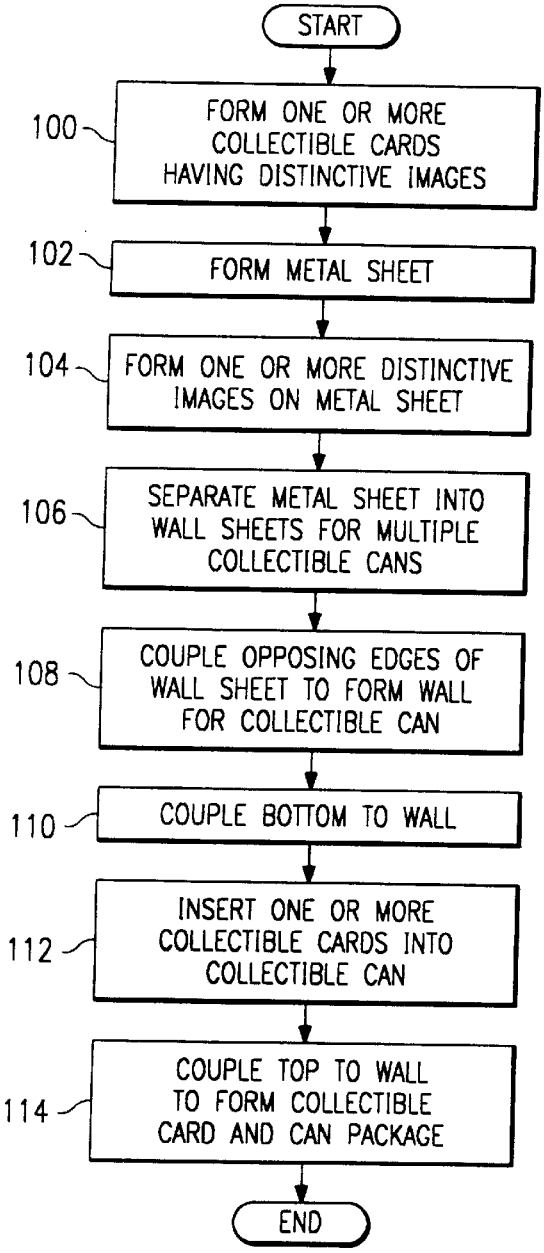
FIG. 4 is a flow chart of an exemplary method of manufacturing a collectible card and can package according to the present invention.

FIG. 4 is a flow chart of an exemplary method of manufacturing collectible package 36. The method begins at step 100, where one or more collectible cards 10 are formed, each card 10 having a distinctive image 32. As discussed above, distinctive image 32 for each card 10 may be identical to or different from distinctive images 32 for other cards 10. At step 102, an appropriate metal sheet is formed from steel plated with tin or any other suitable material. Although the metal sheet may have any suitable size and shape, in one embodiment the metal sheet is a substantially rectangular sheet measuring approximately 32.325 in by approximately 36.417 in with a thickness of approximately 0.0075 in. One or more distinctive images 38 are formed on the metal sheet at step 104 in any suitable manner, for example, in the manner discussed more fully below with reference to FIG. 5. The metal sheet is separated into wall sheets for multiple collectible cans 34 at step 106, although the present invention contemplates the metal sheet being of a size suitable for forming a single can 34 rather than multiple cans 34.

At step 108, opposing edges of a particular wall sheet are seam welded or otherwise coupled to form wall 18 of can 34, which may be substantially circular in cross-section, substantially rectangular in cross-section, or in any other suitable configuration. Bottom 26 is coupled to wall 18 at step 110 and, at step 112, one or more collectible cards 10 are inserted into can 34. In one embodiment, distinctive images 38 of can 34 is related to distinctive images 32 of cards 10. At step 114, top 28 is coupled to wall 18 of can 34 to form collectible card and can package 36, and the method ends. Bottom 26 and top 28 may be coupled to wall 18 using a welding technique, using a rolling technique in which welding is not necessary, or in any other appropriate manner.

Figure 5:
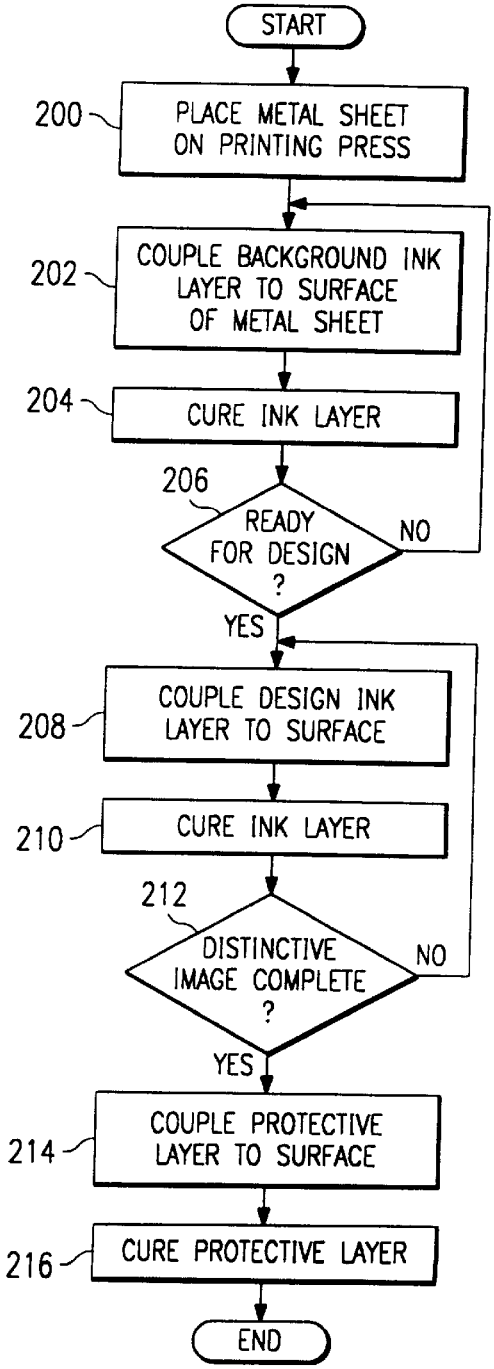
FIG. 5 is a flow chart of an exemplary method of forming a distinctive image for a collectible can according to the present invention.

FIG. 5 is a flow chart of an exemplary method of forming a distinctive image 38 for collectible can 34 on a metal sheet that will become wall 18 of can 34. The method begins at step 200, where the metal sheet is placed on or otherwise associated with a printing press or any other appropriate device or platform. At step 202, a background ink layer, which may be white or any other suitable color, is printed on or otherwise coupled to the metal sheet. The background ink layer is cured in a curing oven or otherwise at step 204, such that the background ink layer adheres to the metal sheet more or less permanently. If the metal sheet is not ready to receive a design ink layer at step 206, such that another background ink layer is desirable, the method returns to step 202. The method continues in this manner until the metal sheet is ready to receive a design ink layer at step 206, which may involve coupling and curing numerous background ink layers as appropriate. In one embodiment, background ink layers are coupled to the surface of the metal sheet until the metal sheet is no longer visible and the metal sheet appears uniformly the color of the background ink layers.

If the metal sheet is ready to receive a design ink layer at step 206, a design ink layer is coupled to the surface of metal sheet at step 208 and cured in a curing oven or otherwise at step 210, such that the design ink layer adheres to the metal sheet more or less permanently. If distinctive image 38 is not complete at step 212, the method returns to step 208, where another design ink layer is coupled to the metal sheet. The method continues in this manner until distinctive image 38 is complete at step 212, which may involve coupling and curing numerous design ink layers. If distinctive image 38 is complete at step 212, a protective lacquer or other layer is coupled to the metal sheet at step 214 and cured in a curing oven or otherwise at step 216, and the method ends.

Although the present invention has been described above in connection with several embodiments, it should be understood that a plethora of changes, substitutions, variations, alterations, transformations, and modifications may be suggested to one skilled in the art, and it is intended that the present invention encompass such changes, substitutions, variations, alterations, transformations, and modifications as fall within the spirit and scope of the appended claims.

What is claimed is:

1. A collectible package, comprising:

a collectible card comprising a face that comprises a first distinctive image;

a substantially cylindrical can comprising a first end, a second end, and a substantially opaque wall coupling the first end and the second end, the wall being substantially continuous between the first and second ends, the card being sealed within the can to form the collectible package; and a pull tab opener coupled to an end of the sealed can and operable to unseal the can in response to a pulling force applied to the pull tab opener.

2. A collectible package, comprising:

a plurality of collectible cards, each card having a face that comprises a first distinctive image, each card having a different first distinctive image selected from among a plurality of first distinctive images, wherein each first distinctive image depicts at least one subject within a category selected from the group consisting of:
a person employed in the sports industry;
a person employed in the music industry;
a person employed in the film industry:
a cartoon character; and
a tourist attraction;

a substantially cylindrical can comprising a first end, a second end, and a substantially opaque wall coupling the first end and the second end, the wall being substantially continuous between the first and second ends, the can comprising a second distinctive image within the category of the first distinctive images, the cards being sealed within the can to form the collectible package; and a pull tab opener coupled to an end of the sealed can and operable to unseal the can in response to a pulling force applied to the pull tab opener.

3. A collectible package, comprising a collectible card comprising a face that comprises a first distinctive image;

a can comprising a first end, a second end, and a wall coupling the first end and the second end, the card being within the can to form the collectible package; and a pull tab opener coupled to an end of the sealed can and operable to unseal the can in response to a pulling force applied to the pull tab opener.

4. The package of claim 3, wherein the first distinctive image depicts at least one subject within a category selected from the group consisting of:
a person employed in the sports industry;
a person employed in the music industry;
a person employed in the film industry;
a cartoon character; and
a tourist attraction.

5. The package of claim 4, wherein the can comprises a second distinctive image depicting at least one subject within the category of the first distinctive image.

6. The package of claim 4, wherein at least one of the ends of the can comprises a third distinctive image depicting at least one subject within the category of the first distinctive image.

7. The package of claim 4, wherein the can has a distinctive shape identified with the category of the first distinctive image.

8. The package of claim 3, wherein the card is a substantially rectangular trading card having substantially horizontal edges and substantially vertical edges approximately 2.5 in and approximately 3.5 in long, respectively.

9. The package of claim 3, wherein the wall of the can defines a window for viewing the card.

10. The package of claim 3, wherein the wall is substantially continuous between the first and second ends.

* * * * *